US006851235B2

(12) United States Patent
Baldwin

(10) Patent No.: US 6,851,235 B2
(45) Date of Patent: Feb. 8, 2005

(54) BUILDING BLOCK WITH A CEMENT-BASED ATTACHMENT LAYER

(76) Inventor: Robert A. Baldwin, 3001 N. Randolph Rd. #19, Phoenix, AZ (US) 85014

( * ) Notice: Subject to any disclaimer, the term of this patent is extended or adjusted under 35 U.S.C. 154(b) by 0 days.

(21) Appl. No.: 10/127,215

(22) Filed: Apr. 22, 2002

(65) Prior Publication Data

US 2002/0112427 A1 Aug. 22, 2002

Related U.S. Application Data

(63) Continuation-in-part of application No. 09/610,288, filed on Jul. 6, 2000, now Pat. No. 6,397,549, which is a continuation-in-part of application No. 08/953,569, filed on Oct. 17, 1997, now Pat. No. 6,085,480, which is a continuation-in-part of application No. 08/852,922, filed on May 8, 1997, now Pat. No. 5,913,791.

(51) Int. Cl.[7] ..... E04C 1/40

(52) U.S. Cl. ..... 52/309.17; 52/309.4; 52/309.12; 52/405.1; 52/605; 52/612

(58) Field of Search ..... 52/309.4, 309.12, 52/309.17, 405.1, 605, 612, 598

(56) References Cited

U.S. PATENT DOCUMENTS

| | | | | | |
|---|---|---|---|---|---|
| 2,701,959 | A | * | 2/1955 | Briggs | 52/505 |
| 2,805,448 | A | * | 9/1957 | Rubenstein | 264/135 |
| 2,817,619 | A | * | 12/1957 | Bickel et al. | 264/245 |
| 2,951,001 | A | * | 8/1960 | Rubenstein | |
| 3,984,957 | A | * | 10/1976 | Piazza | 52/309.9 |
| 4,031,289 | A | * | 6/1977 | Sergovic | 428/451 |
| 4,053,677 | A | * | 10/1977 | Corao | 442/17 |
| 4,186,536 | A | * | 2/1980 | Piazza | 52/309.12 |
| 4,232,494 | A | * | 11/1980 | Bauch et al. | 174/48 |
| 4,478,021 | A | * | 10/1984 | Person | 52/375 |
| 4,628,653 | A | * | 12/1986 | Nash | 52/309.12 |
| 4,774,794 | A | * | 10/1988 | Grieb | 52/309.7 |
| 4,831,802 | A | * | 5/1989 | Cromrich et al. | 52/606 |
| 4,944,127 | A | * | 7/1990 | Clear | 52/309.12 |
| 5,191,744 | A | * | 3/1993 | Bowes | 52/564 |
| 5,231,813 | A | * | 8/1993 | Drawdy | 52/309.12 |
| 5,268,226 | A | * | 12/1993 | Sweeney | 428/312.4 |
| 5,308,572 | A | * | 5/1994 | Hackman | 264/510 |
| 5,482,550 | A | * | 1/1996 | Strait | 106/677 |
| 5,485,703 | A | * | 1/1996 | Nordahl | 52/562 |
| 5,697,189 | A | * | 12/1997 | Miller et al. | 52/79.9 |
| 5,729,943 | A | * | 3/1998 | Cambiuzzi | 52/438 |
| 5,737,896 | A | * | 4/1998 | Rodgers | 52/745.2 |
| 5,913,791 | A | * | 6/1999 | Baldwin | 52/612 |
| 6,046,255 | A | * | 4/2000 | Gray et al. | 523/218 |
| 6,080,234 | A | * | 6/2000 | Clavaud et al. | 106/644 |
| 6,085,480 | A | * | 7/2000 | Baldwin | 52/612 |
| 6,209,284 | B1 | * | 4/2001 | Porter | 52/794.1 |
| 6,397,549 | B1 | * | 6/2002 | Baldwin | 52/596 |
| 2002/0090871 | A1 | * | 7/2002 | Ritchie et al. | 442/42 |
| 2002/0112427 | A1 | * | 8/2002 | Baldwin | 52/309.4 |
| 2003/0150185 | A1 | * | 8/2003 | Godeke et al. | 52/576 |

FOREIGN PATENT DOCUMENTS

| | | | | |
|---|---|---|---|---|
| EP | 000470829 A1 | * | 8/1991 | C04B/40/00 |
| JP | 61-158879 | * | 7/1986 | C04B/38/08 |

* cited by examiner

*Primary Examiner*—Robert Canfield
(74) *Attorney, Agent, or Firm*—Martin & Associates, L.L.C.; Derek P. Martin

(57) ABSTRACT

A building block has a cement-based attachment layer on one or both exterior surfaces of the block that can receive and hold a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the attachment layer.

23 Claims, 7 Drawing Sheets

BUILDING BLOCK WITH A CEMENT-BASED ATTACHMENT LAYER

PARENT APPLICATION

This patent application is a Continuation-In-Part of my previously filed patent application entitled "BUILDING BLOCK WITH A WOODEN ATTACHMENT LAYER", U.S. Ser. No. 09/610,288, filed Jul. 6, 2000, now U.S. Pat. No. 6,397,549, which was a Continuation-In-Part of "BUILDING BLOCK HAVING A WOODEN ATTACHMENT LAYER", Ser. No. 08/953,569, filed Oct. 17, 1997, U.S. Pat. No. 6,085,480, which was a Continuation-In-Part of "BUILDING BLOCK, METHOD FOR MAKING THE SAME, AND METHOD FOR BUILDING A WALL USING THE SAME", Ser. No. 08/852,922, filed May 8, 1997, U.S. Pat. No. 5,913,791. All three of these previous patent applications are incorporated herein by reference.

BACKGROUND OF THE INVENTION

1. Technical Field

This invention generally relates to construction materials and techniques, and more specifically relates to a building block, a method for making the building block, and a method for building a wall using the building block.

2. Background Art

Building blocks have been used for centuries to construct homes, office buildings, churches, and many other structures. Early building blocks were hewn from stone into appropriate shapes that were assembled together, typically using mortar, to form a wall. In modern times, various types of concrete blocks were developed, which are typically formed by pouring a cement mixture into a form and allowing the cement to harden. This type of cement block is strong and makes for a sturdy wall, but installing a traditional concrete block requires a skilled mason that places mortar in all joints between blocks to secure the blocks in place.

Various different block configurations have been developed that allow mortar to be poured into inner passageways of the blocks once the blocks have been constructed into a wall. Some of these eliminate the need for a mason to apply mortar between the blocks as the blocks are laid because the blocks are interlocked using mortar poured into interior passages. Examples of blocks with inner passages are found in U.S. Pat. No. 4,295,313, "Building Blocks, Wall Structures Made Therefrom, and Methods of Making the Same", issued Oct. 20, 1981 to Rassias; U.S. Pat. No. 4,319,440, "Building Blocks, Wall Structures Made Therefrom, and Methods of Making the Same", issued Mar. 16, 1982 to Rassias; U.S. Pat. No. 2,701,959, "Sectional Block Masonry", issued Feb. 15, 1955 to Briggs; and Swiss Pat. No. 354237, issued Jun. 30, 1961.

One significant drawback of using concrete blocks to form walls in a structure is that surficial covering material often needs to be applied to the surface of the walls. Many common surficial coverings for walls are attached using nails or screws. For example, siding may need to be applied to the outside of the wall, and wallboard, paneling, or other sheet material may need to be applied to the inside of the wall. Known concrete blocks are too hard and brittle to allow commonly-used nails or screws to be used to attach a surficial covering material. As a result, special concrete nails or anchors are typically used to secure wood furring strips or studs to the concrete block wall, and the covering materials are, in turn, fastened to the furring strips or studs. This process of fastening wood furring strips or studs to the block wall and nailing on the covering material to the furring strips is time-consuming, and the concrete blocks do not hold the nails or anchors in place very well. It is not uncommon for one or more of the concrete nails to become loose when a surficial material is nailed in place, compromising the structural integrity of the wall.

Therefore, there existed a need to provide an improved building block with an attachment layer that allows covering materials to be directly attached to the building blocks using conventional nails, screws, or staples.

DISCLOSURE OF INVENTION

According to the present invention, a building block has a cement-based attachment layer on one or both exterior surfaces of the block that can receive and hold a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the attachment layer.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The building block of the present invention allows any suitable material to be directly fastened (e.g., screwed, nailed, or stapled) to it. A cement-based attachment layer on the block allows fasteners to be directly attached to the block.

Figure 1:
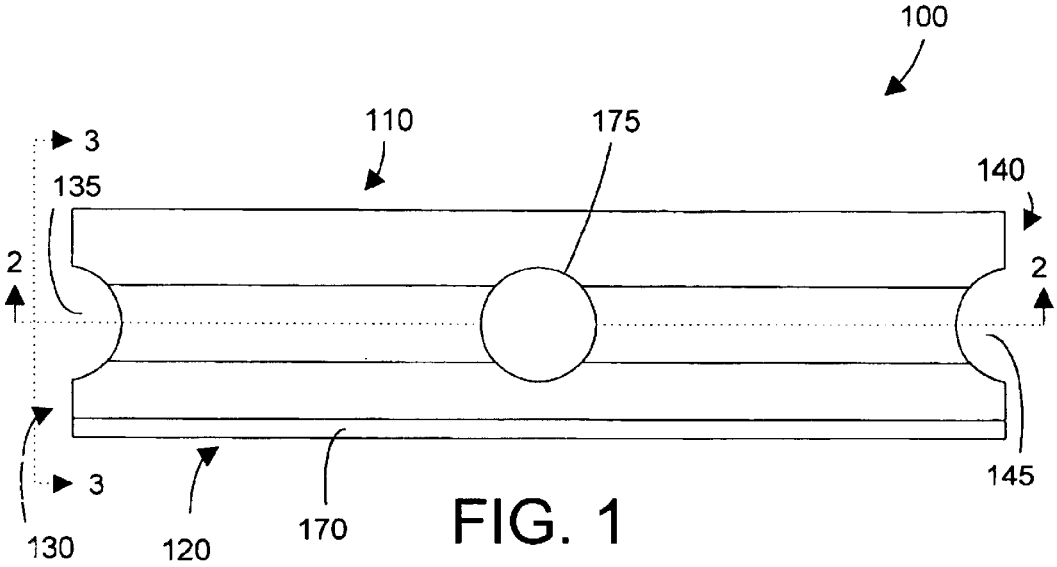
FIG. 1 is a top view of a building block in accordance with the present invention.

Referring now to FIGS. 1–4, a building block 100 in accordance with the preferred embodiment includes a first exterior surface 110, a second exterior surface 120, a first side surface 130, a second side surface 140, a top surface 150, and a bottom surface 160. Either or both of the first exterior surface 110 and the second exterior surface 120 include an attachment layer 170. For purposes of illustrating the attachment layer 170 in the figures, attachment layer 170 in FIG. 1 is shown on exterior surface 120. Note, however, that attachment layer 170 may be located on either or both of the exterior surfaces 110 and 120.

Each of the side surfaces 130 and 140, the top surface 150, and the bottom surface 160 include corresponding substantially semi-cylindrical concave portions 135, 145, 155 and 165. In addition, block 100 further includes a cylindrical channel 175. These concave portions and cylindrical channel of one block align with similar concave portions and cylindrical channels on adjacent blocks to form a cross-linked structure of substantially cylindrical channels when the building blocks are assembled into a wall. These channels preferably have a circular cross-section, but may have other geometries within the scope of the present invention.

Block 100 is preferably comprised of a mixture of cement, water, a wetting agent, and a suitable insulative material. The cement is preferably Portland cement, type 1, ASTM designation C150 or similar. The preferred wetting agent is Polyheed 997, a liquid manufactured and marketed by Master Builders Technologies, ASTM C494, 2126 E. 5$^{th}$ Street, Tempe, Ariz., 85281. The term "wetting agent" is used herein as a general term that describes a broad category of additives for concrete that include plasticizers, superplasticizers, and water reducers. The general function of these additives is to act as a wetting agent, which helps the cement and water paste in the cement mixture to adhere to the other parts of the mixture. In the particular application for the preferred embodiments, the wetting agent is added to assure the wet cement mixture adequately adheres to and more completely covers the insulative material.

The preferred insulative material is a synthetic bead material with a suitable diameter less than 2.5 cm (1 inch), a preferable diameter less than 1.3 cm (0.5 inch), and a most preferred diameter of 3.2 mm (⅛ inch) to 9.5 mm (⅜ inch). The insulative material may be any suitable insulative material, such as polyurethane, polycyanuarate, betostyrene, etc. The preferred insulative material is expanded polystyrene (EPS) foam beads. The best mode of the invention uses a mixture of different bead sizes ranging from 3.2 mm (⅛ inch) to 9.5 mm (⅜ inch). The proportions of water, cement, wetting agent, and EPS foam beads for the block mix are suitably 68 to 95 liters (18 to 25 gallons) water to 150 to 190 kg (325 to 425 lb) cement to 0.24 to 0.71 liters (1 to 3 cups) wetting agent to 850 to 1400 liters (30 to 50 cubic feet) EPS foam beads. The preferred proportions for the block mix are 76 to 87 liters (20 to 23 gallons) water to 160 to 180 kg (350 to 400 lb) cement to 0.35 to 0.59 liters (1.5 to 2.5 cups) wetting agent to 990 to 1,270 liters (35 to 45 cubic feet) EPS foam beads. The proportions in accordance with the best mode of the invention for the block are most preferably 81.4 liters (21.5 gallons) water to 171 kg (376 lb) cement to 0.47 liters (2 cups) wetting agent to 1,080 liters (38 cubic feet) EPS foam beads.

In an alternative embodiment, class F fly ash may be substituted for some of the concrete in the block mix. Class F fly ash is commercially available from the Phoenix Cement Company, P.O. Box 43740, Phoenix, Ariz., 85080. The result of using fly ash in the block mix is a block that has a hardness at 28 days that is the same as the block that does not contain fly ash, but that gets harder and stronger as time goes on at a faster rate than the regular block mix that does not contain fly ash. The proportions of water, cement, fly ash, wetting agent, and EPS foam beads for the block mix are suitably 68 to 95 liters (18 to 25 gallons) water to 109 to 147 kg (240 to 325 lb) cement to 31 to 45 kg (68 to 100 lb) fly ash to 0.24 to 0.71 liters (1 to 3 cups) wetting agent to 850 to 1400 liters (30 to 50 cubic feet) EPS foam beads. The preferred proportions for the block mix are 76 to 87 liters (20 to 23 gallons) water to 118 to 138 kg (260 to 305 lb) cement to 34 to 42 kg (75 to 93 lb) fly ash to 0.35 to 0.59 liters (1.5 to 2.5 cups) wetting agent to 990 to 1,270 liters (35 to 45 cubic feet) EPS foam beads. The proportions in accordance with the best mode of the invention for the block are most preferably 81.4 liters (21.5 gallons) water to 128 kg (282 lb) cement to 38 kg (84 lb) fly ash to 0.47 liters (2 cups) wetting agent to 1,130 liters (40 cubic feet) EPS foam beads.

One suitable admixture that improves the block mix is the addition of an air entrainer. One suitable air entrainer is a product called Microair, which is available from Master Builders Technologies, ASTM C494, 2126 E. 5$^{th}$ Street, Tempe, Ariz., 85281. Air entrainer causes the cement to foam or bubble when being mixed, thus causing air bubbles to be embedded (or entrained) into the concrete mix. The addition of air entrainer into the block mix results in the following proportions: 68 to 95 liters (18 to 25 gallons) water to 150 to 190 kg (325 to 425 lb) cement to 0.24 to 0.71 liters (1 to 3 cups) wetting agent to 850 to 1400 liters (30 to 50 cubic feet) EPS foam beads to 0.18 liter (0.25 to 0.75 cup) air entrainer for the block mix above with the broadest ranges of ingredients; 76 to 87 liters (20 to 23 gallons) water to 160 to 180 kg (350 to 400 lb) cement to 0.35 to 0.59 liters (1.5 to 2.5 cups) wetting agent to 990 to 1,270 liters (35 to 45 cubic feet) EPS foam beads to 0.08 to 0.16 liter (0.33 to 0.67 cup) air entrainer for the block mix above with the narrower ranges of ingredients; and most preferably 81.4 liters (21.5 gallons) water to 171 kg (376 lb) cement to 0.47 liters (2 cups) wetting agent to 1,080 liters (38 cubic feet) EPS foam beads to 0.12 liter (0.5 cup) air entrainer for the mix that represents the best mode of the invention.

The best mode of the invention for the block mix includes the proportions of water, cement, wetting agent, EPS foam beads, and air entrainer specified above. The best mode also has a specific order of mixing the ingredients. First, the wetting agent is mixed into the specified quantity of water. Next, the air entrainer is added to the water mixture and mixed in. Next, the cement is added. The cement slurry is then mixed until most of the large clumps of cement have been eliminated. Once the cement and water mixture has been fully mixed, the EPS foam beads are added and mixed thoroughly. This order of mixing has provided the best results in practice, but this best mode of the invention does not limit the preferred embodiments to this order. The preferred embodiments expressly extend to any suitable order or method for mixing the ingredients together.

In the preferred embodiment, the attachment layer 170 has a composition that is different than the block material described above. The preferred composition of the attachment layer 170 includes water, cement, and space-occupying granules. The term "space-occupying granules" is not a term of art, but is a term that is introduced herein to mean any small granule that has the capability of interrupting the concrete mix matrix so that it becomes less rigid and brittle.

In the preferred embodiments, space-occupying granules may have at least three different forms. The first is granules that have a rigid or semi-rigid shell that substantially encloses an open, hollow area. Another possibility is granules that are substantially pliable and enclose an open, hollow area. Yet another possibility is granules that are substantially pliable and substantially solid. In applicant's issued U.S. Pat. No. 5,913,791, the use of expanded polystyrene (EPS) foam beads having a diameter of 3.18 to 9.53 mm (⅛ to ⅜ inch) is disclosed for use in a cement-based attachment layer. EPS foam beads would fall in the third category of space-occupying granules, those that are substantially pliable and substantially solid. While EPS foam beads do interrupt the concrete matrix to the point of making the attachment layer able to receive a penetrating fastener, subsequent tests have shown that EPS foam beads in the attachment layer do not disperse evenly in the mix, and do not provide for a consistent penetrating effort and holding strength. Subsequent research and development has determined that smaller space-occupying granules provide much more uniform penetrating and holding characteristics for penetrating fasteners.

The preferred embodiment for the space-occupying granules is glass microbubbles (or microspheres). These microbubbles are of the first type listed above, namely, they have a substantially rigid shell that encloses a substantially hollow area. These microbubbles are readily available and are relatively inexpensive. One commercially-available product that is suitable for use as microbubbles is Fil-cel type 42-18 manufactured by American Stone Pioneer, P.O. Box 4083, Rolling Hills, Calif., 90274. These microbubbles are microscopic glass (or silica) spheres. The microbubbles are so small that they appear as white dust to the naked eye. Introducing the microbubbles into the concrete mix injects minute regions of air (entrapped in the microbubbles) in the mix, resulting in a concrete mix that is less rigid and brittle. The purpose of the microbubbles is to change the characteristics of the concrete mix so it can accept screws, nails, or other penetrating fasteners, while also providing good holding power for these fasteners. In this manner, materials may be attached to the attachment layer 170 using standard penetrating fasteners and conventional tools.

While the preferred materials for the microbubbles is silica or glass, other materials could also be used to form the space-occupying granules within the scope of the preferred embodiments, which expressly extend to any and all materials that create substantially enclosed spaces that are very small in size, preferably less than 1 mm (0.04 inch) in size. In addition, the space-occupying granules could be non-spherical shapes as well, so long as they occupy small areas of space in the concrete mix that will create an attachment layer capable of receiving and holding a penetrating fastener. The space-occupying granules could also be solid rather than a hollow bubble, which would be particularly useful for pliable materials such as plastic or rubber materials. The term "space-occupying granule" as used herein and in the claims means any and all material that can occupy space in a concrete-based mix, thereby changing the characteristics of the concrete mix so it can receive and hold a penetrating fastener when the mix is cured. As stated above, the preferred size for the space-occupying granules is less than 1 mm (0.04 inch). Note that substantially rigid granules that are substantially solid (such as grains of sand) do not fall within the scope of space-occupying granules disclosed herein.

For the best mode of the invention that uses glass microbubbles, the proportions of water, cement, and microbubbles for the attachment layer mix are suitably 26 to 38 liters (6.9 to 10 gallons) water to 54.4 to 72.6 kg (120 to 160 lb) cement to 2.3 to 23 kg (5 to 50 lb) microbubbles. The preferred proportions of the attachment layer are 29 to 35 liters (7.6 to 9.2 gallons) water to 59.0 to 68.0 kg (130 to 150 lb) cement to 4.5 to 11 kg (10 to 25 lb) microbubbles. The proportions in accordance with the best mode of the invention for the attachment layer are most preferably 32 liters (8.4 gallons) water to 63.5 kg (140 lb) cement to 6.8 kg (15 lb) microbubbles. Formulating the attachment layer 170 according to the proportions above results in an attachment layer 170 that can receive and hold standard penetrating fasteners such as nails, screws, and staples.

Other items such as synthetic or natural materials may be added to attachment layer 170 to enhance its ability to hold fasteners. Suitable synthetic materials include fiberglass, kevlar, polypropylene, and metal wire, in any suitable form, including filaments, fibers, strands, fabrics, powders, etc. Suitable natural materials include cotton, hemp, flax, cellulose, animal hair, perlite, vermiculite, etc. The proportions of these materials depend on the characteristics of the specific material used and the desired holding strength for attachment layer 170. For the preferred embodiment, fiberglass strands (also known as glass fibers) are added to the preferred attachment layer mix, resulting in the following proportions: 26 to 38 liters (6.9 to 10 gallons) water to 54.4 to 72.6 kg (120 to 160 lb) cement to 2.3 to 23 kg (5 to 50 lb) microbubbles to 2.3 to 9.1 kg (5 to 20 lb) fiberglass strands for the mix above with the broadest ranges of ingredients; 29 to 35 liters (7.6 to 9.2 gallons) water to 59.0 to 68.0 kg (130 to 150 lb) cement to 4.5 to 11 kg (10 to 25 lb) microbubbles to 4.5 to 6.4 kg (10–14 lb) fiberglass strands for the mix above with the narrower ranges of ingredients; and most preferably 32 liters (8.4 gallons) water to 63.5 kg (140 lb) cement to 6.8 kg (15 lb) microbubbles to 5.4 kg (12 lb) fiberglass strands for the mix that represents the best mode of the invention. The fiberglass strands are preferably alkali-resistant, and are preferably less than 3.18 mm (⅛ inch) in diameter and less than 2.54 cm (1 inch) in length. One example of a suitable fiberglass strand that is commercially available is Cem-FIL, available from Cem-FIL International, The Parks, Newton-Le-Willows, Mercyside WA120JQ England.

In addition to adding synthetic or natural materials to attachment layer 170 as described above, the formulation of the attachment layer 170 may be improved by adding one or more admixtures to the attachment layer mix. Examples of suitable admixtures include air-entrainers (such as those compliant with ASTM C 260), bonders (such as latex, polyvinyl chloride, polyvinyl acetate, acrylics, or butadiene-styrene copolymers), plasticizers, superplasticizers, and the like. Many materials (such as those listed above) may improve the ability of attachment layer 170 to hold fasteners in place, and their addition to the mix for attachment layer 170 is within the scope of the preferred embodiments.

Note that the ranges specified herein are believed to be workable ranges for the various ingredients in the block mix. However, it is possible that certain combinations within the ranges specified would not produce a block with the desired strength. Different formulations within the specified ranges are possible that will produce different properties of the resultant block.

Figure 5:
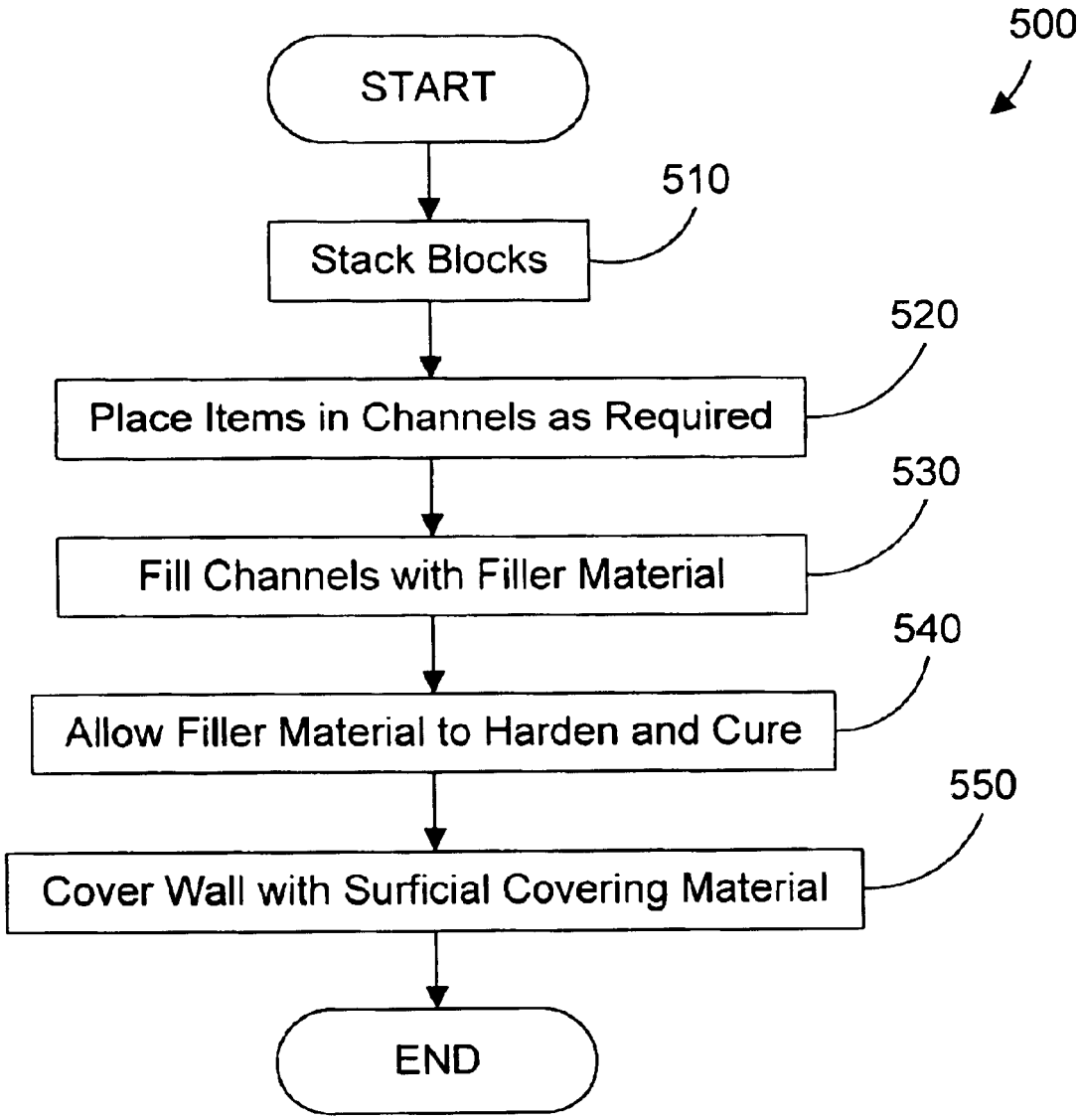
FIG. 5 is a flow diagram of a method for building a wall in accordance with the preferred embodiments using the block of FIG. 1.
Figure 6:
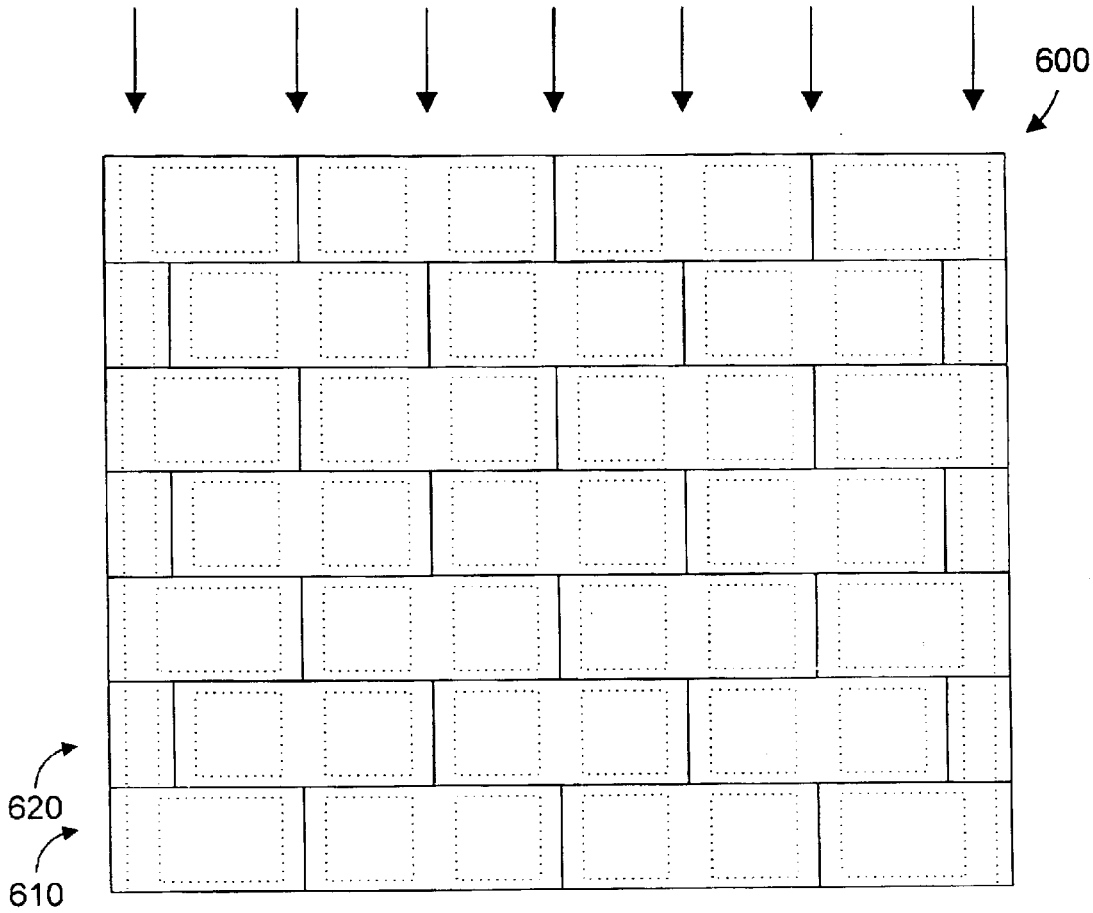
FIG. 6 is a front view of a block wall in accordance with the preferred embodiments.
Figure 7:
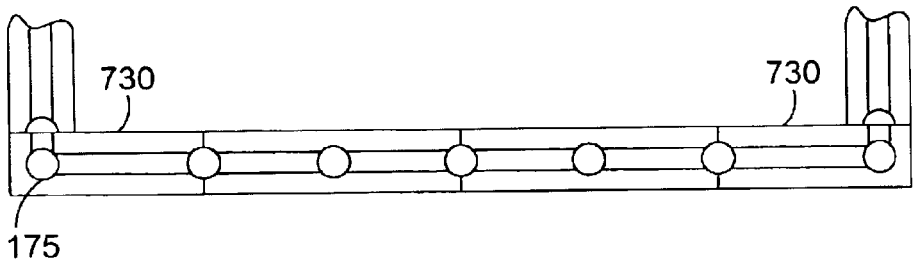
FIG. 7 is top view of the wall of FIG. 6.
Figure 8:
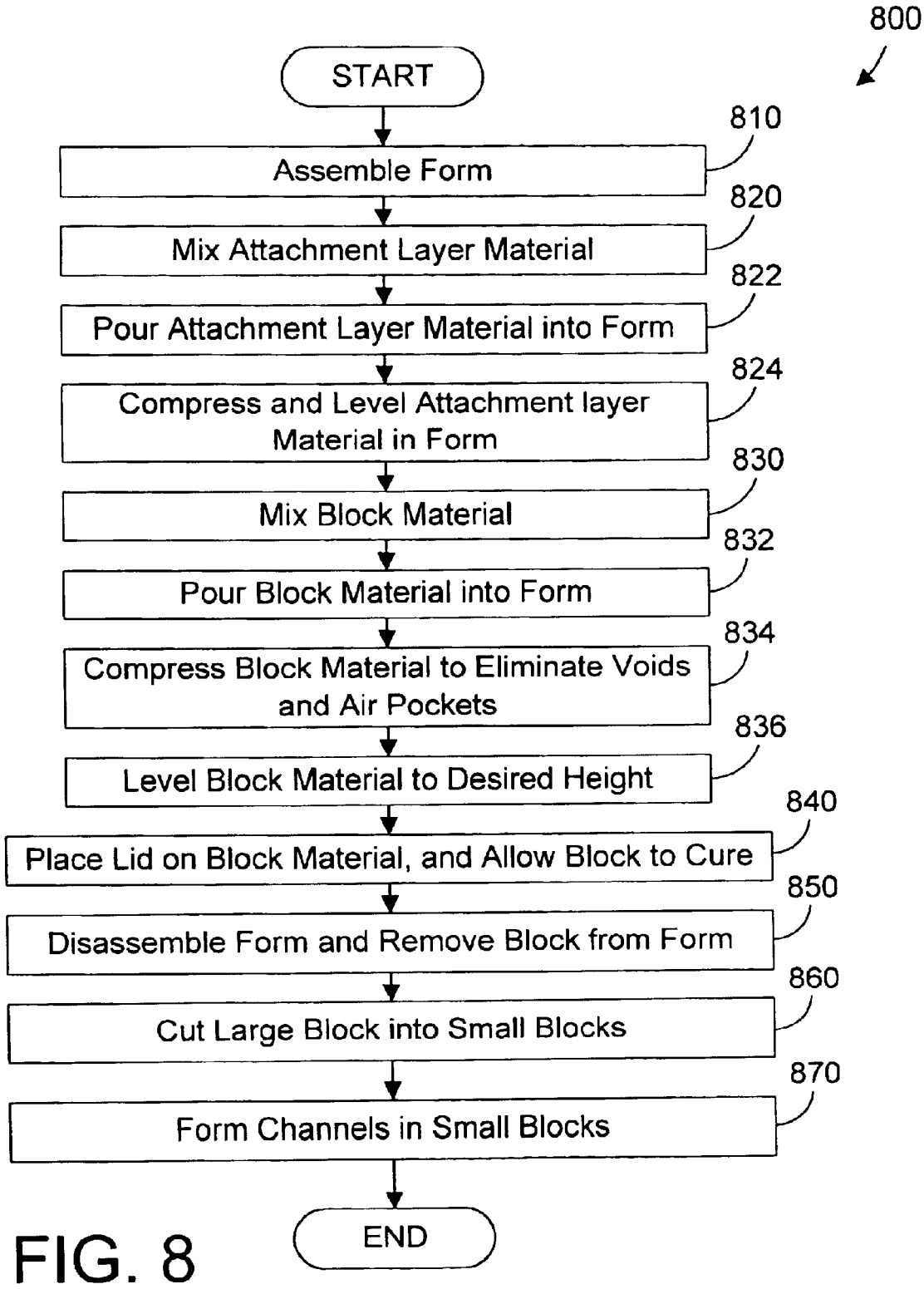
FIG. 8 is a flow diagram of a method for manufacturing the block of FIG. 1.

Referring now to FIGS. 5–7, a method 500 for building a wall 600 using a plurality of blocks 100 begins by stacking the blocks (step 510). Block 100 is designed so that a wall is built by putting down a first course (or row) 610 of blocks end-to-end without mortar, then stacking the second course of blocks 620 on the first course of blocks without mortar in staggered fashion so that each block in the second course overlaps two blocks in the first course. Referring to FIGS. 1–4, with blocks 100 stacked to form a wall as shown in FIG. 6, the concave portions 135 and 145 of corresponding side portions 130 and 140 of a block in the course above are aligned above cylindrical channels 175 in the blocks below, and the concave portions 135 and 145 of corresponding side portions 130 and 140 of the lower blocks are aligned below the cylindrical channel 175 of the blocks above.

Note that if the blocks have a single attachment layer on one exterior surface (110 or 120), the attachment layer 170 of each block must be aligned with the side of the wall where the attachment layer is needed during the stacking of the blocks in step 510. Of course, if an attachment layer 170 is present on both exterior surfaces 110 and 120, no such alignment is required.

During the stacking of the blocks 100, various items may be placed within the cross-linked structure of channels as required (step 520). For example, electrical cable, water and waste pipes, gas pipes, and reinforcing steel bar (known as rebar) may be put within the channels. These channels provide natural passageways for routing these items to their desired locations. Openings from the channels to the exterior of the block may be made using a drill, router, saw, or any other suitable tool to accommodate the exit points for plumbing, electrical wires, and the like. Note that excessive items within these channels may compromise the structural integrity of the wall if they significantly reduce the amount of filler material in the channel. As a result, it may be preferable to have only rebar in the channels, and to run all electrical cables and pipes in recesses cut in the surface of the block.

Once two or more courses are stacked in place, with the desired rebar, cable, and/or pipes in place within the channels, a suitable filler material is then poured into the exposed openings at the top of the blocks (step 530). The preferred filler material is a cement-based grout that has a plastic consistency that allows it to flow by the force of gravity to fill all of the channels in the blocks. The grout material is referred to herein as a plastic material, not because the grout contains any plastic, but because the grout, when wet, has plastic properties. Suitable grout typically has a slump of 20–25 cm (8–10 inches). The best mode formulation for the grout is 299 kg (658 lb) cement to 170 kg (375 lb) water to 1,270 kg (2800 lb) aggregate, where the aggregate is preferably 75% sand and 25% pea gravel no greater than 1.3 cm (½ inch) in diameter. Note that the consistency of the filler material must allow the filler material to flow around all items located in the channels. Of course, many suitable filler materials other than grout may be used within the scope of the present invention. For example, a variety of injected foam, plastic, adhesive, or epoxy compounds would be suitable filler materials. In the preferred method of constructing a wall using blocks 100, the blocks for the entire wall are stacked in place (step 510) and all of the required items are routed in the channels (step 520) before the filler material is added (step 530). In this manner the filler material need only be poured once after all of the blocks for the wall are in place (as shown by the arrows in FIG. 6), rather than by pouring at different levels as the wall goes up.

Building a block wall 600 in accordance with method 500 requires corner blocks 730 that are different than the block 100 of FIG. 1 that is used in the middle of wall 600. These differences must be present to ensure that the resulting cross-linked structure of substantially cylindrical channels is closed within the wall 600 so that there is no open access from the channels to outside the wall, except for the openings at the top of the wall. A closed system will assure that no filler material that is poured into the network of channels will spill out. As a result, as the filler material fills the channels, the pressure from the material causes the filler material to fill the voids in the channels. As shown in FIG. 7, the semi-cylindrical concave portions of the corner blocks 730 do not extend from one side of the block to the other, but make a right-angle turn toward the adjacent wall. Corner blocks 730 have the same width and height as block 100, and have a preferred length that is the sum of the width of the block plus half the length of the block. In the preferred embodiment, block 100 has a width of 28 cm (11 inches), a height of 40.6 cm (16 inches), and a length of 122 cm (48 inches), so corner block 730 has a width of 28 cm (11 inches), a height of 41 cm (16 inches), and a length of 89 cm (35 inches).

After the filler material is poured in place (step 530), it is allowed to harden and cure (step 540). Once the filler material has cured, any suitable surficial covering material may be attached to the exposed attachment layer 170 using any suitable fastener that at least partially penetrates attachment layer 170 (step 550). For example, if the interior side of an exterior wall 600 has an attachment layer 170, any suitable wall material (such as wallboard and paneling) may be directly nailed, stapled, or screwed to the attachment layer 170. Likewise, if the exterior side of an exterior wall has an attachment layer 170, any suitable exterior covering material (such as siding) may be directly nailed, stapled, or screwed to the attachment layer 170. Allowing a wall covering material to be directly fastened to wall 600 using standard fasteners eliminates the time and expense of furring out the walls with wood members.

Figure 9:
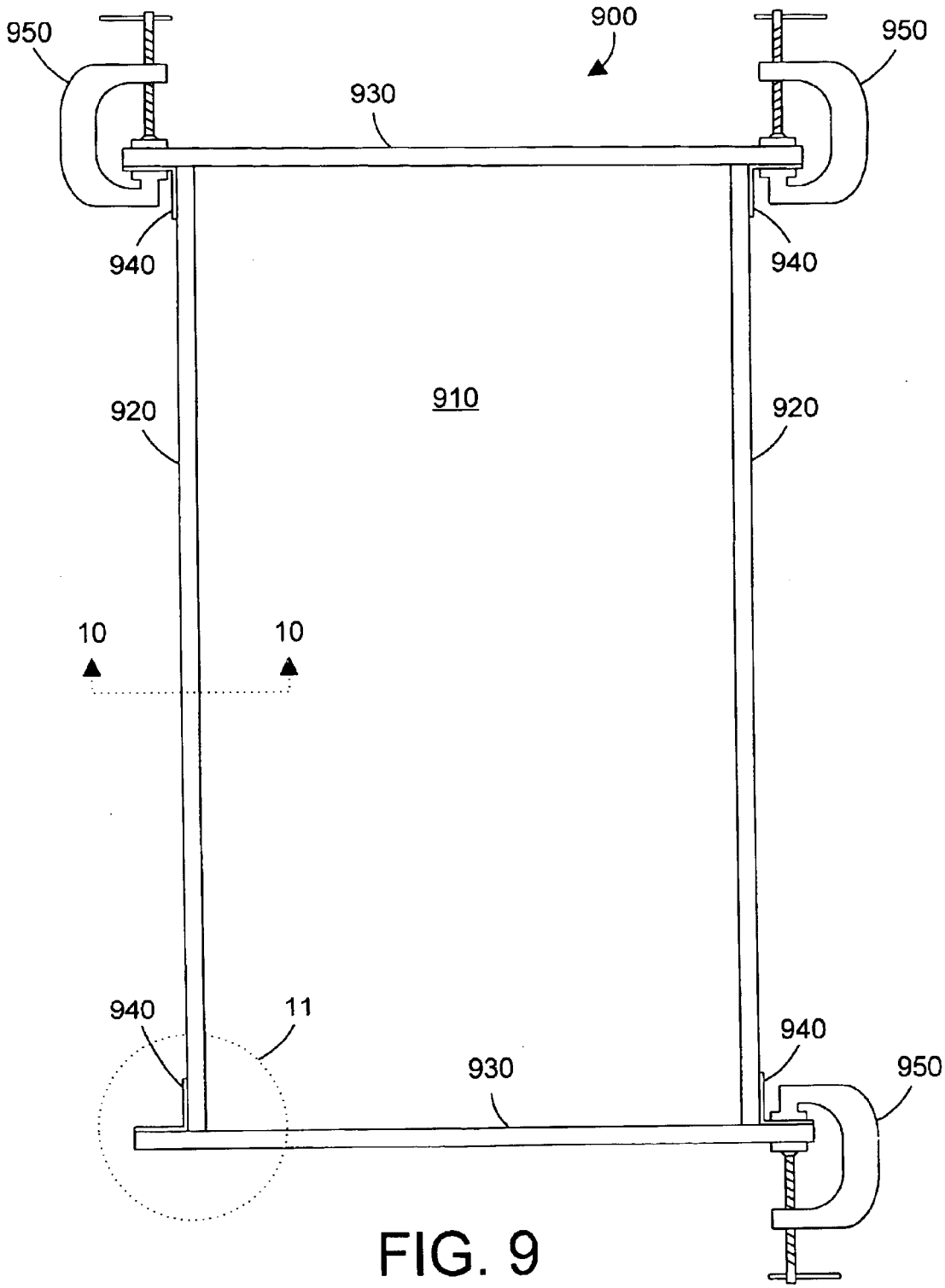
FIG. 9 is a top view of a form for forming a large block that is cut into small blocks like the block of FIG. 1.

Referring now to FIGS. 8–11, a method 800 for forming a block 100 (of FIG. 1) starts with a form 900 as shown in FIG. 9. The first step in method 800 is to assemble the form (step 810). The assembly of the form can be understood with reference to FIGS. 9–11. Form 900 has a bottom portion 910, side portions 920, and end portions 930. Each of these portions 910, 920, and 930 of form 900 are all preferably coated with a non-stick substance to ensure that the block does not stick to the form. Examples of suitable non-stick coatings include wax, form oil, teflon, or other form release agents.

Figure 10:
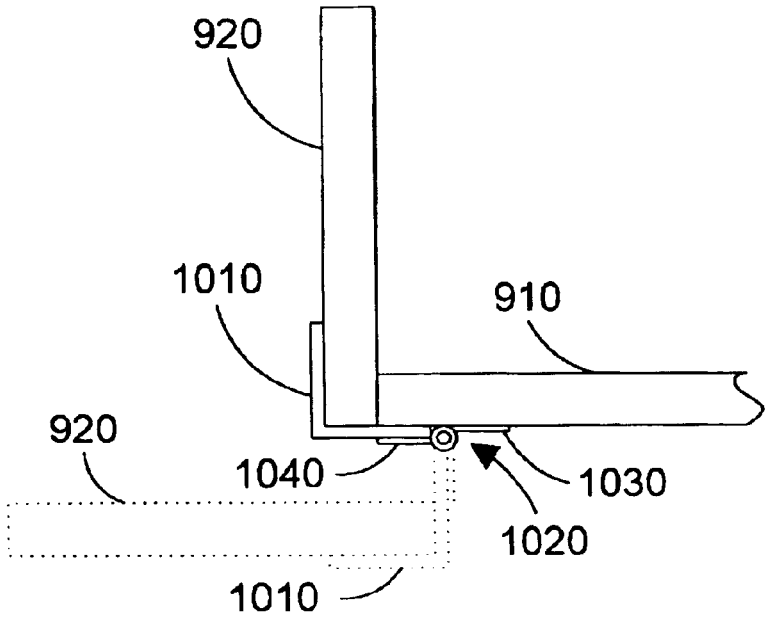
FIG. 10 is a cross-sectional view of a side piece 920 of the form assembly taken along the line 10—10 in FIG. 9.

Side portions 920 are pivotally coupled to the bottom portion 910 to allow the side portions 920 to pivot away from the bottom portion 910. The pivoting action of the side portions 920 with respect to the bottom portion 910 is shown in the cross-sectional view of FIG. 10. Note that the features at the end of portion 920 in the direction of the cross section 10—10 (such as the angle portion 940, the clamp 950, and the end portion 930) are not shown in FIG. 10 for the purpose of clarity. In the specific implementation in FIG. 10, a portion of right-angle material 1010 runs along the length of side portion 920 and under the bottom of side portion 920 and part of bottom portion 910. Right angle material 1010 is used to reinforce the side portion 920 and the bottom portion 910 to assure these do not bend while the block is being formed. Right angle material 1010 is preferably angle iron, but could be any suitable material with the requisite stiffness and strength to reinforce side portion 920 and bottom portion 910. In the specific implementation in FIG. 10, right angle material 1010 is fixedly coupled to the side portion 920. A hinge 1020 has a first tab 1030 that is fixedly coupled to the bottom portion 910, and a second tab 1040 that is fixedly coupled to the right angle material 1040. In this manner the right angle portion 1010 and side portion 920 can pivot away from the bottom portion 910, as shown in FIG. 10 in phantom. Any suitable manner known in the art may be used to attach the right angle material 1010 to the side portion 920, to attach the hinge tab 1040 to the right angle material 1010, and to attach the hinge tab 1030 to the bottom portion 910, including nails, screws, adhesives, welding, etc. In the preferred implementation, side portion 920 and bottom portion 910 are ¾ inch form plywood that is treated for contacting concrete, and right angle material 1010 is screwed into the side portion 920, hinge tab 1040 is screwed to right angle material 1010, and hinge tab 1030 is screwed to bottom portion 910.

Figure 11:
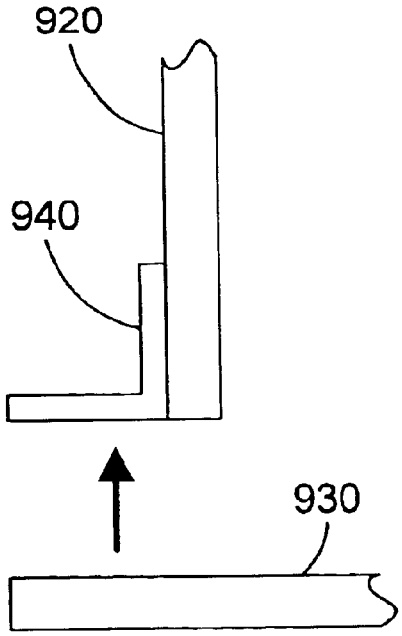
FIG. 11 is an enlarged view showing how the side piece 920 and end piece 930 come together for clamping as shown in the circular area 11 of FIG. 9.

When the form is being assembled in step 810, the side portions 920 are pivoted to a substantially right angle position with respect to the bottom portion 910, as shown by the solid representation of side portion 920 in FIG. 10. Once the side portions are in place, the end portions can then be positioned and clamped in place. FIG. 11 is an enlargement showing the assembly of corner portion 11 in FIG. 9. End portions 930 are separate pieces from side portions 920 and bottom portion 910. The end portions 930 are preferably as high as the side portion 920, and wide enough to span beyond side portions 920 to the edge of the right angle corner pieces 940, as shown in FIG. 11. Right angle corner pieces 940 are fixedly attached to side portion 920, and run along the height of side portion 920. An end piece 930 is positioned next to the side piece with its corresponding right angle corner piece 940, and is pressed against the right angle corner piece 940. Referring to FIG. 9, a C-clamp 950 is then used to attach the end portion 930 to the right angle corner piece 940, as shown in three of the corners in FIG. 9. A C-clamp is preferably placed at the bottom and at the top of the end portion 930 at each corner, which means that each end portion 930 is secured to the two side portions using four C-clamps. Note that a square is preferably used when performing the clamping operation to assure that side portions 920 are square with respect to bottom portion 910.

With the form now assembled, the blocks in accordance with the preferred embodiments may be made. Referring again to FIG. 8, the attachment layer material is then mixed (step 820). The ingredients and proportions of the attachment layer material are provided above. Once thoroughly mixed, the attachment layer material is placed along the bottom portion 910 of the form (step 822). In the preferred embodiment, a layer of thin plastic is placed along the bottom portion 910 of the form to inhibit the attachment layer from sticking to the bottom portion 910. Many different thicknesses of plastic may be used, but experience has shown that 2 mil plastic provides the most satisfactory results. The attachment layer material is then compressed to remove air pockets and leveled in the form (step 824). This compression can be done in a variety of ways. One suitable way uses a tool referred to as a "tamper" that has a flat surface parallel to the ground with a handle extending upwards. A person takes the tamper, raises it up and forces it down on the block material, forcing out all voids and air pockets. Of course, other techniques, including automated techniques, could also be used to compress the block material.

Next, the block material is mixed (step 830). The ingredients and proportions of the block material are provided above. Once thoroughly mixed, the block material is poured into the form (step 832). Once the block material is poured in the form, the block material is compressed to eliminate voids and air pockets (step 834). This compression may be done using a tamper or using any suitable manual or automated technique. Once compressed, the block material is leveled to the desired block height (step 836). In the preferred embodiments, the block material is "screeded off", as is common in working with concrete, using a board or other straight edge to scrape off the excess block material to a depth of 28 cm (11 inches) of block material remaining in the form. Once the block mix is leveled, a lid is placed on the block material, and the block material is allowed to cure (step 840). The purpose of the lid is to avoid drying the surface of the block mix before it has adequately cured, and practical experience shows that using the lid provides a more strong and uniform surface on the block than blocks that cure without a lid. Of course, the lid is optional, and curing without a lid is within the scope of method 800.

Other steps may also be performed within the scope of the preferred embodiments. For example, after the lid is placed on the block material, one or more braces can be placed to pull the side portions 920 together, to assure the large block does not bulge. One suitable brace is a length of lumber with a slot that has a length that fits over the side portions 930 of the form to precisely space the side portions of the form from each other. Another suitable brace is a metal tube with perpendicular members attached to its end with the same spacing. In this manner the width of the large block is precisely controlled, providing better consistency between different batches of blocks. Of course, other steps could also be performed with the process steps in method 800.

Once the block is cured, the form is disassembled, and the block is removed from the form (step 850). Note that this block is a big block, from which several of the blocks in FIG. 1 may be made. The large block is now cut into several small blocks (step 860). In the preferred embodiment, form 900 has interior dimensions of 122 cm (48 inches) by 249 cm (98 inches) by 36 cm (14 inches) deep. The form is 36 cm (14 inches) deep because the block material is not compressed when initially poured into the form. Once compressed, the block material is screeded off to leave 28 cm (11 inches) of block material. The large blocks that come out of the form are thus 122 cm (48 inches) wide by 249 cm (98 inches) long by 28 cm (11 inches) thick. In the preferred embodiments, the large block is cut across its width in 41 cm (16 inch) widths, resulting in 6 blocks out of each 98 inch large block that are each 41 cm (16 inches) high, 28 cm (11 inches) wide, and 122 cm (48 inches) long. In the preferred embodiment, the large block is placed on a roller table and is fed through a set of five saw blades that cut the block of material into six equal portions, each of which becomes a single block as shown in FIGS. 1–4.

Figure 2:
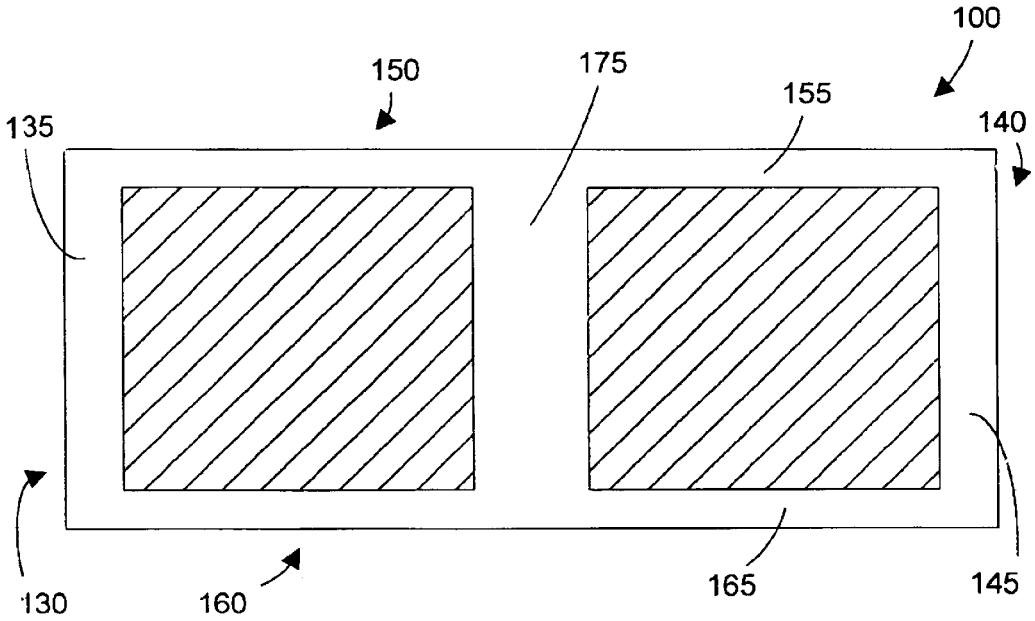
FIG. 2 is a cross-sectional view of the block of FIG. 1 taken along the lines 2—2.
Figure 3:
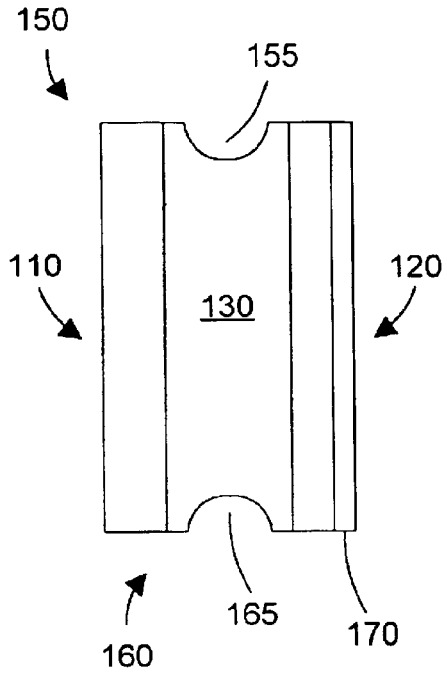
FIG. 3 is a side view of the block of FIG. 1 taken along the lines 3—3.
Figure 4:
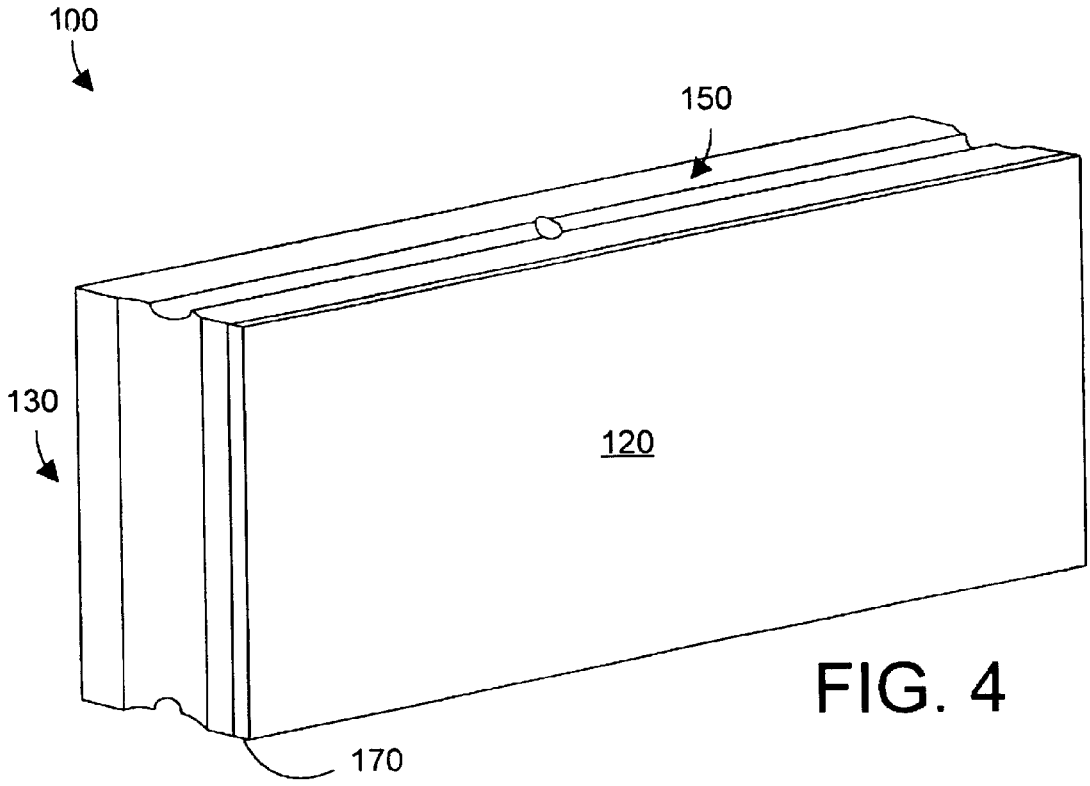
FIG. 4 is a perspective view of the block of FIG. 1.

Next, the channels must be formed in each small block (step 870). Referring to FIG. 2, one suitable way to form the semi-cylindrical channels 135 and 145 and the cylindrical channel 175 is to place block 100 in a hydraulic press that pushes three sharpened steel pipes through the block. One of these pipes cuts channel 135, another cuts channel 175, and the last cuts channel 145. Once these channels are formed, the block is then pushed into a chute that has two sharpened steel pipes to cut the top channel 155 and the bottom channel 165. Of course, other methods for forming the channels are within the scope of the preferred embodiments, including drilling, sawing, routing, forming, or any other method that could be used to form these channels.

In the best mode of the invention, the size of the channels in block 100 is as follows: the diameter of the cylindrical channel 175 is 15 cm (6 inches); the vertical semi-cylindrical concave portions 135 and 145 each have a diameter of 15 cm (6 inches); and the horizontal semi-cylindrical concave portions 155 and 165 each have a diameter of 10 cm (4 inches). The dimensions of block 100 allow a wall to be quickly and efficiently constructed, and the dimensions of the channels help assure that filler material will flow around any items (such as pipe, rebar, cables, etc.) that are placed within the channels.

Note that the units herein are expressed in both metric and English units, so this patent application can be prosecuted in foreign jurisdictions that require metric units without changes to the specification. The preferred embodiments are implemented in English units, and any variation between the stated English units and their metric equivalents is due to rounding errors, with the English units being the more correct measurement of the two.

While the invention has been particularly shown and described with reference to preferred embodiments thereof, it will be understood by those skilled in the art that various changes in form and details may be made therein without departing from the spirit and scope of the invention. For example, a block may be made in a variety of different sizes. In addition, the size, number and geometries of the channels 175 and concave portions 135, 145, 155 and 165 may vary from that disclosed herein.

I claim:

1. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

wherein the building block comprises a mixture of water, cement, and expanded polystyrene (EPS) foam beads that have a diameter from 3.18 mm (⅛ inch) to 9.53 mm (⅜ inch) in the proportions of:

from 68 to 95 liters (18 to 25 gallons) water;

from 150 to 190 kg (325 to 425 lb) cement; and from 850 to 1400 liters (30 to 50 cubic feet) EPS foam beads.

2. The building block of claim 1 wherein the building block further comprises a wetting agent.

3. The building block of claim 2 wherein the wetting agent is selected from the group consisting of water reducers, plasticizers, and superplasticizers.

4. The building block of claim 1 further comprising from 0.06 to 0.18 liter (0.25 to 0.75 cup) air entrainer.

5. A building block comprising:

a first exterior surface, first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

wherein the building block comprises a mixture of water, cement, and expanded polystyrene (EPS) foam beads that have a diameter from 3.18 mm (⅛ inch) to 9.53 mm (⅜ inch) in the proportions of:

from 76 to 87 liters (20 to 23 gallons) water;

from 160 to 180 kg (350 to 400 lb) cement; and from 990 to 1,270 liters (35 to 45 cubic feet) EPS foam beads.

6. The building block of claim 5 further comprising from 0.08 to 0.16 liter (0.33 to 0.67 cup) air entrainer.

7. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

wherein the building block comprises a mixture of water, cement, and expanded polystyrene (EPS) foam beads that have a diameter from 3.18 mm (⅛ inch) to 9.53 mm (⅜ inch) in the proportions of:

approximately 81.4 liters (21.5 gallons) water;

approximately 171 kg (376 lb) cement; and approximately 1,0809 liters (38 cubic feet) EPS foam beads.

8. The building block of claim 7 further comprising approximately 0.12 liter (0.5 cup) air entrainer.

9. The building block of claim 1 wherein:

each first and second side surface comprises a substantially semi-cylindrical concave portion;

the top surface comprises a substantially semi-cylindrical concave portion; and the bottom surface comprises a substantially semi-cylindrical concave portion;

the substantially semi-cylindrical concave portions forming a cross-linked structure of substantially cylindrical channels when a plurality of the building blocks are assembled into a wall.

10. The building block of claim 1 further comprising a cement-based attachment layer substantially covering at least one of the first and second exterior surfaces.

11. The building block of claim 10 wherein the cement-based attachment layer comprises water, cement, and space-occupying granules having a size of less than 1 mm (0.04 inch) in the proportions of:

from 26 to 38 liters (6.9 to 10 gallons) water;

from 54.4 to 72.6 kg (120 to 160 lb) cement; and from 2.3 to 23 kg (5 to 50 lb) space-occupying granules.

12. The building block of claim 11 wherein the space-occupying granules comprise glass microbubbles.

13. The building block of claim 11 wherein the cement-based attachment layer further comprises from 2.3 to 9.1 kg (5 to 20 lb) fiberglass strands.

14. The building block of claim 10 wherein the cement-based attachment layer comprises water, cement, and space-occupying granules having a size of less than 1 mm (0.04 inch) in the proportions of:

from 29 to 35 liters (7.6 to 9.2 gallons) water;

from 59.0 to 68.0 kg (130 to 150 lb) cement; and from 4.5 to 11 kg (10 to 25 lb) space-occupying granules.

15. The building block of claim 14 wherein the space-occupying granules comprise glass microbubbles.

16. The building block of claim 14 wherein the cement-based attachment layer further comprises from 2.3 to 9.1 kg (5 to 20 lb) fiberglass strands.

17. The building block of claim 10 wherein the cement-based attachment layer comprises water, cement, and space-occupying granules having a size of less than 1 mm (0.04 inch) in the proportions of:

approximately 32 liters (8.4 gallons) water;

approximately 63.5 kg (140 lb) cement; and approximately to 6.8 kg (15 lb) space-occupying granules.

18. The building block of claim 17 wherein the space-occupying granules comprise glass microbubbles.

19. The building block of claim 17 wherein the cement-based attachment layer further comprises approximately 5.4 kg (12 lb) fiberglass strands.

20. A building block comprising:

a first exterior surface;

first and second side surfaces coupled to the first exterior surface, each first and second side surface comprising a substantially semi-cylindrical concave portion;

a top surface coupled to the first exterior surface and to the first and second side surfaces, the top surface comprising a substantially semi-cylindrical concave portion extending between the first and second side surfaces;

a bottom surface coupled to the first exterior surface and to the first and second side surfaces, the bottom surface comprising a substantially semi-cylindrical concave portion extending between the first and second side surfaces;

a second exterior surface coupled to the first and second side surfaces, to the top surface, and to the bottom surface;

each of the first and second side surfaces and the top and bottom surfaces comprising a mixture in the proportions of:

approximately 21.5 gallons (81.4 liters) water;

approximately 171 kg (376 lb) cement; and approximately 1080 liters (38 cubic feet) expanded polystyrene foam beads with a diameter from 3.18 mm (⅛ inch) to 9.53 mm (⅜ inch);

a cement-based attachment layer substantially covering at least one of the first and second exterior surfaces.

21. The building block of claim 20 wherein the cement-based attachment layer comprises water, cement, and space-occupying granules having a size of less than 1 mm (0.04 inch) in the proportions of:

approximately 32 liters (8.4 gallons) water;

approximately 63.5 kg (140 lb) cement; and approximately to 6.8 kg (15 lb) space-occupying granules.

22. The building block of claim 21 wherein the space-occupying granules comprise glass microbubbles.

23. The building block of claim 21 wherein the cement-based attachment layer further comprises approximately 5.4 kg (12 lb) fiberglass strands.

* * * * *